US006250982B1

(12) United States Patent
Kashima

(10) Patent No.: US 6,250,982 B1
(45) Date of Patent: Jun. 26, 2001

(54) EXHAUST ARRANGEMENT FOR OUTBOARD MOTOR

(75) Inventor: Yukinori Kashima, Hamamatsu (JP)

(73) Assignee: Sanshin Kogyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/116,697

(22) Filed: Jul. 16, 1998

(30) Foreign Application Priority Data

Jul. 17, 1997 (JP) ..... 9-207431

(51) Int. Cl.[7] ..... B63H 21/32
(52) U.S. Cl. ..... 440/89; 440/900
(58) Field of Search ..... 440/88, 89, 900; 123/195 P; 181/235, 261; 60/310

(56) References Cited

U.S. PATENT DOCUMENTS 3,052,087 * 9/1962 Kiekhaefer ..... 181/235
4,983,135 * 1/1991 Boda et al. ..... 440/89
5,232,387 * 8/1993 Sumigawa ..... 440/89

* cited by examiner

*Primary Examiner*—Ed Swinehart
(74) *Attorney, Agent, or Firm*—Knobbe, Martens, Olson & Bear, LLP

(57) ABSTRACT

An exhaust system for an outboard motor wherein the exhaust pipe which depends into the expansion chamber formed in the drive shaft housing is provided with a separate cooling jacket. Water from this separate cooling jacket is discharged into the expansion chamber at a point well below the discharge end of the exhaust pipe in a direction away from the exhaust pipe so as to avoid water ingestion into the engine through the exhaust system. A second expansion chamber communicates with an above the water exhaust gas discharge. This second expansion chamber communicates with the first expansion chamber through a restricted path formed in part by a flange of the exhaust pipe.

24 Claims, 14 Drawing Sheets

EXHAUST ARRANGEMENT FOR OUTBOARD MOTOR

BACKGROUND OF THE INVENTION

This invention relates to an outboard motor and more particularly to an exhaust arrangement for outboard motors.

As is well known, the design of the exhaust system for an outboard motor is an area that presents considerable problems. The reason for this is that the space available for treating and silencing the exhaust gases before discharge to the atmosphere is quite small. For that reason, it has been the practice to discharge the exhaust gases under most running conditions through an underwater exhaust gas discharge. Thus, the body of water in which the watercraft is operating may be utilized as a silencing medium.

In addition to this, the problem of discharging cooling water from the engine when the engine is of the water-cooled type, as is typical with most outboard motors. In an outboard motor, the engine cooling system relies on water from the body of water in which the watercraft is operating. This water is circulated through the engine and then returned back to the body of water in which the watercraft is operated. In this way, the body of water actually acts as a heat exchanger for the engine cooling which provides significant improvement.

It has been the practice to utilize an arrangement wherein the cooling water is returned along with the exhaust gases to the body of water. If this is done in a proper way, the water that has been drawn from within the body of water in which the watercraft is operating can also be utilized to cool the exhaust gases and provide some silencing.

However, since most outboard motors use two-cycle engines, there are some particular dangers in doing this. With two-cycle engines, there is frequently a negative pulse in the exhaust system during a normal operating cycle. Thus, if the cooling water is discharged in proximity to the exhaust system, it may actually be drawn into the combustion chamber during this negative pulse condition. Obviously, this is not desirable.

It is, therefore, a principal object of this invention to provide an improved exhaust system for an outboard motor.

It is a further object of this invention to provide an exhaust system for an outboard motor wherein the coolant for the engine can also be employed to cool the exhaust system.

It is a further object of the invention to provide an exhaust system cooling arrangement for an outboard motor as described, wherein the cooling water is returned in such a way that it will not come into direct contact with the exhaust gases and thus cannot be drawn back into the engine.

Frequently, the drive shaft housing of the outboard motor is employed in some manner as an expansion chamber. This expansion chamber cooperates with an exhaust pipe that delivers the exhaust gases from the engine into the expansion chamber, and which functions to assist in the silencing of the exhaust gases before they are discharged into the water. Frequently, the cooling water from the engine is also discharged into this expansion chamber and thus this gives rise to the possibility of water injection through the exhaust system, as before referred to.

It is a further object of this invention to provide an improved outboard motor exhaust system employing an expansion chamber in the drive shaft housing and in which the exhaust gases and water can be mixed in such a way that the water is not directed toward the exhaust pipe.

SUMMARY OF THE INVENTION

This invention is adapted to be embodied in an outboard motor comprised of a power head and a drive shaft housing and lower unit depending from the power head. The power head contains a powering internal combustion engine and a surrounding protective cowling. A propulsion device is contained within the lower unit for propelling an associated watercraft through a body of water in which it is operating. A transmission system transmits drive from the engine to this propulsion device. An expansion chamber is formed in the drive shaft housing and an exhaust pipe depends from the engine exhaust system into this expansion chamber for deliver of exhaust gases to the expansion chamber. The expansion chamber is defined by an outer peripheral wall. A cooling jacket is provided along a side of the exhaust pipe and receives coolant for cooling the exhaust pipe. The coolant water from this cooling jacket is returned to the body of water in which the watercraft is operating by a discharge passage from the cooling jacket which is directed toward the wall of the expansion chamber and away from the exhaust pipe.

DETAILED DESCRIPTION OF THE PREFERRED EMBODIMENT

Figure 1:
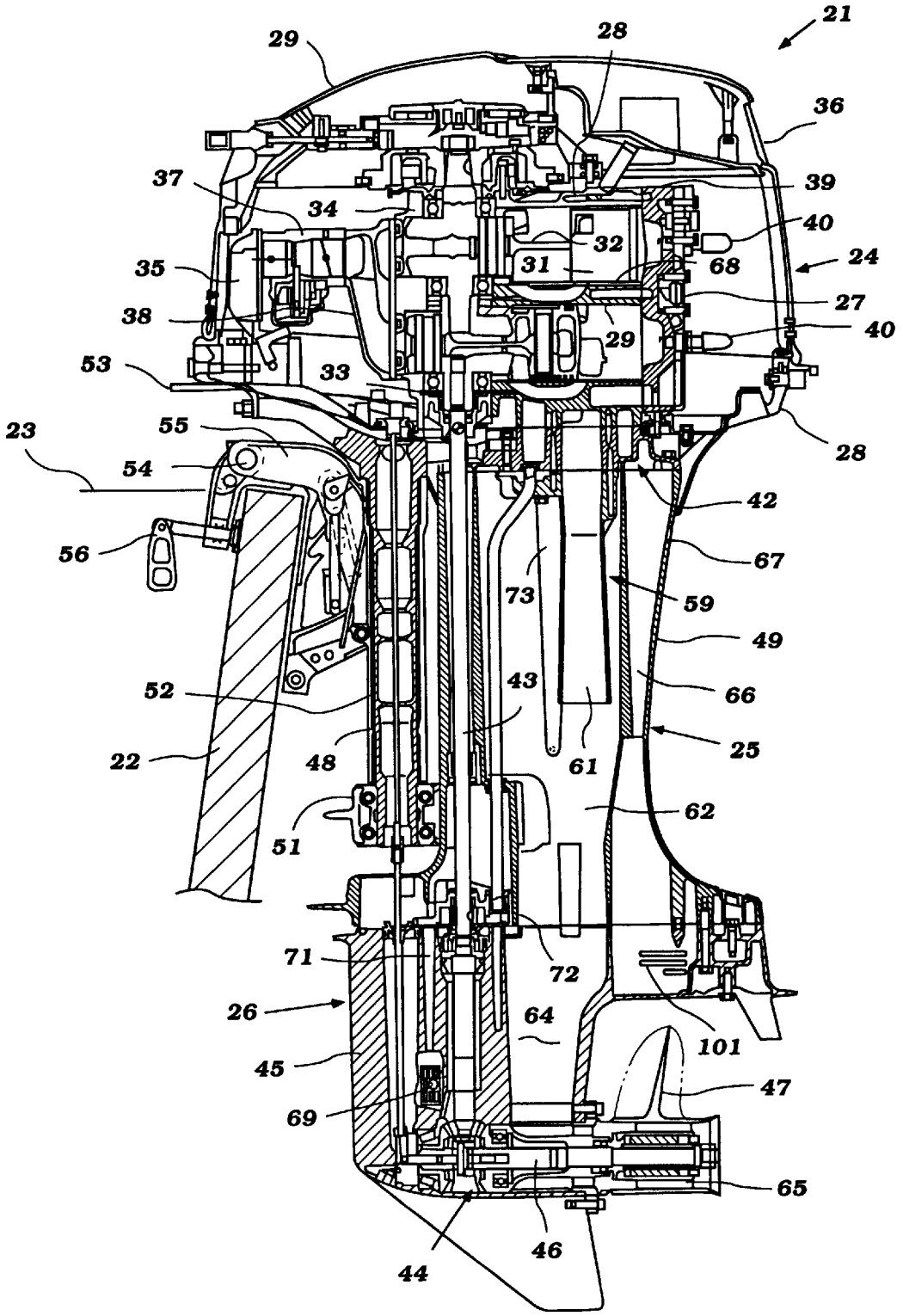
FIG. 1 is a side elevational view of an outboard motor constructed in accordance with an embodiment of the invention and shown attached to the transom of an associated watercraft. The outboard motor is shown in cross section as is the transom of the associated watercraft, which is shown only partially.
Figure 2:
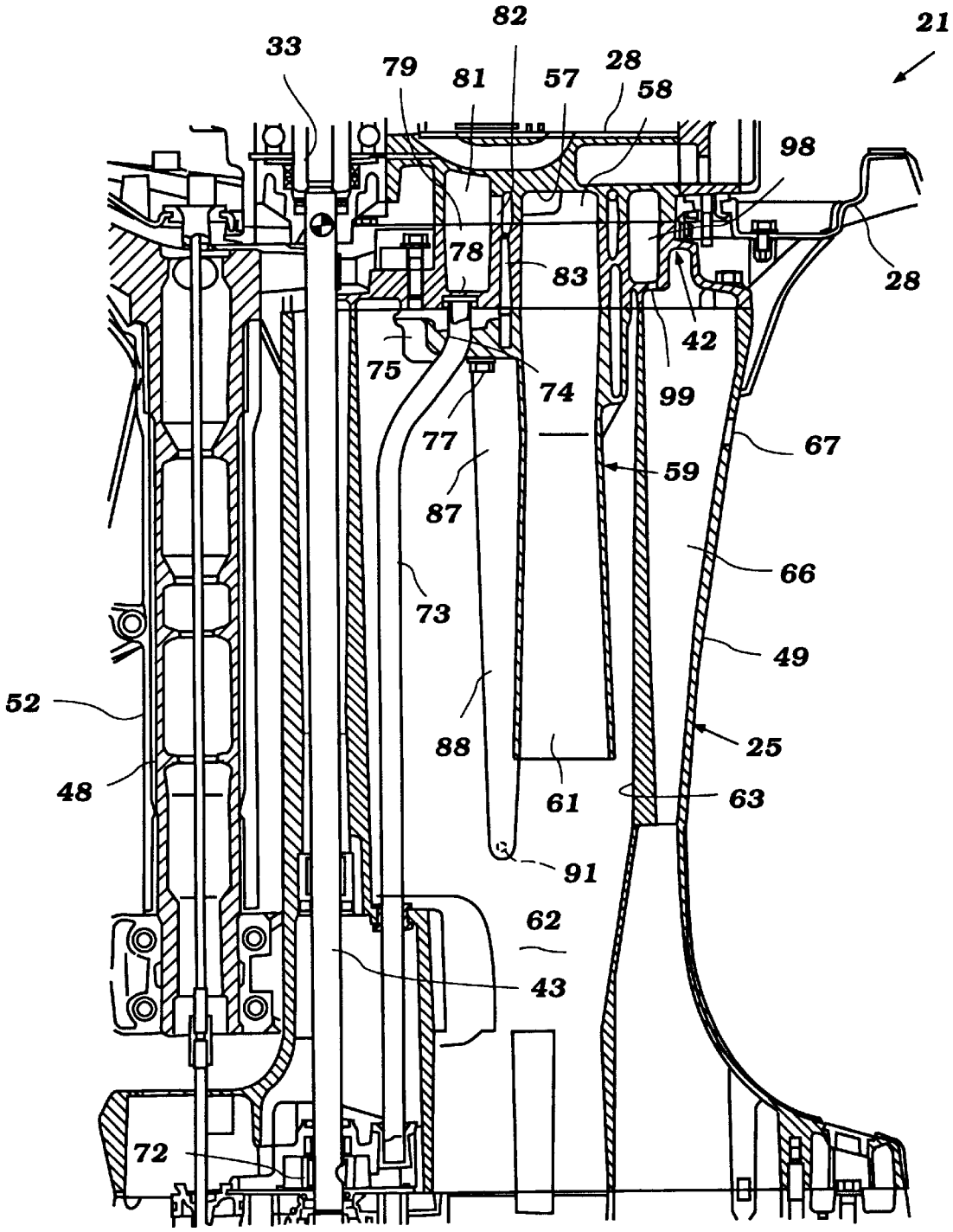
FIG. 2 is an enlarged, partial view looking in the same direction as FIG. 1 and in the same cross section.

Referring now in detail to the drawings and initially to FIGS. 1 and 2, an outboard motor constructed in accordance with the preferred embodiment of the invention is identified generally by the reference numeral 21 and is shown attached to the transom 22 of a watercraft 23 which is propelled by the outboard motor 21. The outboard motor 21 is comprised of a power head, indicated generally by the reference numeral 24; a drive shaft housing, indicated generally by the reference numeral 25 and a lower unit, indicated generally by the reference numeral 26.

The power head 24 is comprised of a powering internal combustion engine, indicated generally by the reference numeral 27, and a surrounding protective cowling which includes a lower tray 28 and an upper main cowling member 29 that is detachably connected to the tray 28 in a known manner. The tray 28 is preferably formed from a light weight, high-strength material such as aluminum or an aluminum alloy. The main cowling member 29 is, on the other hand, formed from a lighter weight somewhat less rigid material such as a molded fiberglass reinforced resin or the like.

The engine 27 in the illustrated embodiment is depicted as being of the two-cylinder inline type and operates on a two-stroke, crankcase compression principle. Although this form of engine is illustrated and will be described, it will be apparent to those skilled in the art how the invention can be utilized with a wide variety of types of engines having different cylinder numbers, different configurations, and even those operating on a four-stroke principle. However, the invention has particular utility in conjunction with two-cycle engines inasmuch as these engines have fairly substantial overlap in their porting and, at times, high negative pressures in the exhaust system.

Although the invention deals primarily with the exhaust system, some details of the engine 27 will be described so as to facilitate understanding of the invention. The engine 27 includes a cylinder block 28 that provides a pair of horizontally extending cylinder bores 29 which have their axis lying one above the other. This is typical with outboard motor practice, for a reason which will be described.

Pistons 31 reciprocate in the cylinder bores 29 and are connected by means of connecting rods 32 to a crankshaft 33. Because of the horizontal disposition of the cylinder bores, the crankshaft 33 rotates about a vertically extending axis. This facilitates its connection to the propulsion system for the watercraft, as will become apparent shortly.

The crankshaft 33 is rotatably journalled in a crankcase chamber formed by a crankcase member 34 that is affixed to one end of the cylinder block 28 and which closes the lower ends of the cylinder bores along with the pistons 31. As is typical with two-cycle crankcase compression engine practice, crankcase chamber sections are formed, each of which is associated with a respective one of the cylinder bores 29. These crankcase chamber sections are suitably sealed from each other.

An induction system is provided for supplying a fuel and air charge to these crankcase chamber sections. This induction system includes an air silencer device 35 that is positioned within a forward location of the protective cowling and which draws atmospheric air from within the protective cowling. This air is admitted into the protective cowling through an inlet opening 36 formed in a rearwardly facing portion of the main cowling member 29.

This intake air is then delivered to a carburetor 37 which, in turn, supplies the crankcase chambers through an intake manifold 38. As is typical with two-cycle practice, the intake manifold 38 ends in intake ports formed in the crankcase member 34. Read-type check valves are provided in these intake ports so as to permit a charge to be drawn into the crankcase chamber. However, as this charge is compressed by downward movement of the pistons 31 in the cylinder bores, the read-type check valve will be closed to prevent reverse flow.

At this time, the charge is then transferred to combustion chambers formed in part by a cylinder head assembly 39 that is affixed to the other end of the cylinder block and which closes the opposite ends of the cylinder bores 29. This transfer takes place through one or more scavenge passages in a manner well known in the art.

The charge is then further compressed in the combustion chambers and is fired by spark plugs 40 mounted in the cylinder head assembly 39. The spark plugs 40 are fired by a suitable ignition system.

Figure 3:
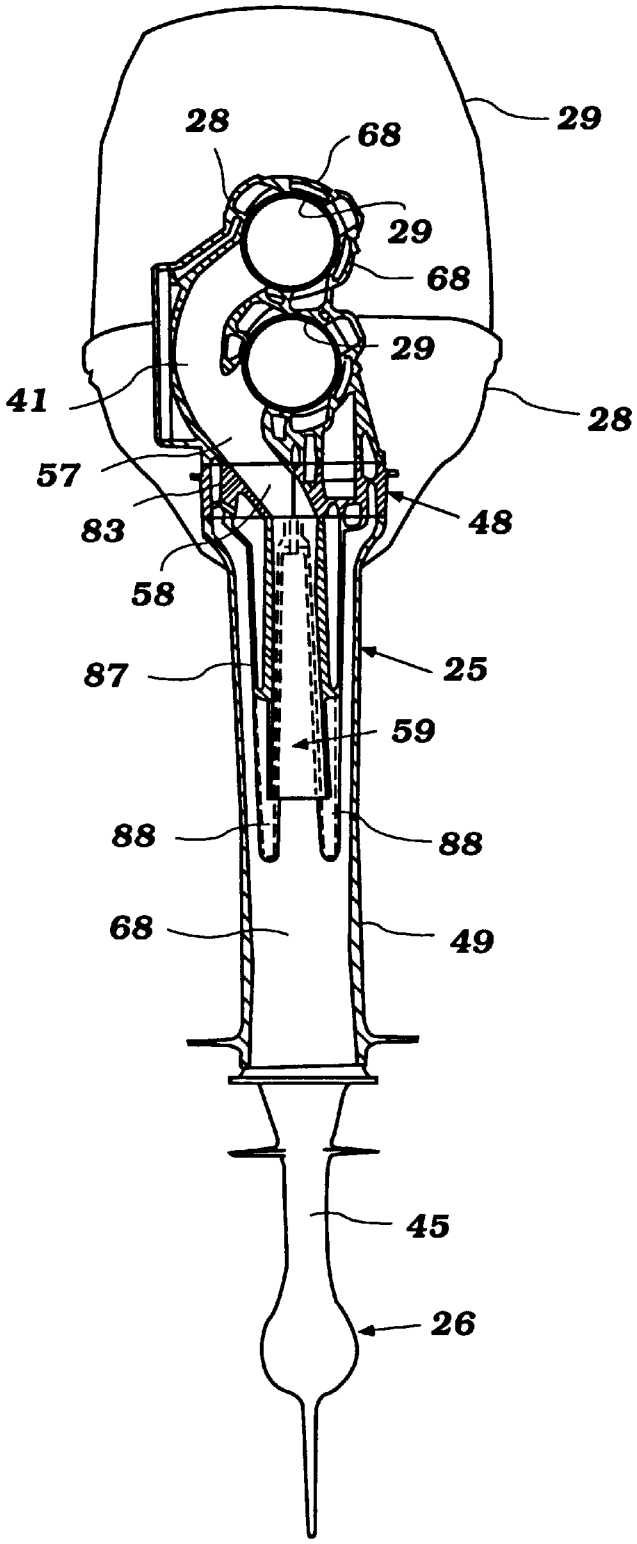
FIG. 3 is a rear elevational view of the outboard motor, with portions broken away and shown in section.

The burnt charge is then delivered to exhaust ports formed in the cylinder block 28 and which cooperate with an exhaust manifold 41 (FIG. 3) also formed in the cylinder block 28. These exhaust gases are then delivered downwardly to an exhaust guide, indicated generally by the reference numeral 42 and upon which the engine 27 is mounted. The remainder of the exhaust system will be described in more detail later.

The engine crankshaft 23 is connected by means of a splined connection to a drive shaft 43 which extends into and is journalled within the drive shaft housing 25. This drive shaft 43 continues onto the lower unit and specifically to drive a conventional forward, neutral, reverse transmission indicated generally by the reference numeral 44 therein. This transmission 44 is contained within a cavity formed by the outer housing 45 of the lower unit 26.

A propeller shaft 46 is journalled within this lower unit outer housing 45 and is driven in selected forward or reverse directions by the transmission 44 for driving a propulsion device such as the propeller 47 in like directions.

A steering shaft 48 is connected to the drive shaft housing 25 and specifically the main outer housing member 49 thereof by means of a lower bracket assembly 51. In addition, the upper end of this steering shaft is affixed in a suitable manner to the exhaust guide 42. This steering shaft 48 is journalled within a swivel bracket 52. This pivotal movement within the swivel bracket 52 permits steering movement of the outboard motor 21 for controlling the direction of travel of the watercraft 23 in a known manner. A tiller 53 is affixed to the upper end of the steering shaft 48 for this purpose.

The swivel bracket 52 is, in turn, connected by means of a pivot pin 54 to a clamping bracket 55. Pivotal movement about the pivot pin 54 permits tilt and trim adjustment of the outboard motor 21 and also permits it to be tilted up to and out of the water condition, as is also well known in this art. A clamp unit 16 is connected to the clamping bracket 55 for permitting detachable connection of the outboard motor 21 to the transom 22.

The construction of the outboard motor as thus far described may be considered to be conventional and, for that reason, further details of the outboard motor construction which have not been described may be considered to be conventional. Those skilled in the art can resort to any known constructions in the art for details of any construction which have not been illustrated that may be necessary to practice the invention. The invention deals primarily with the treatment of the exhaust gases and the manner in which they are discharged to the atmosphere as well as the cooling system for the engine and its relationship to this exhaust system.

It has been noted that the engine and specifically the cylinder block 28 is provided with the internal exhaust manifold 41 which collects the exhaust gases from the engine cylinders and assist in their discharge to the atmosphere. The discharge from this exhaust manifold 41 appears partially in FIG. 2 and in FIG. 3 and is indicated at 57. This exhaust discharge passage 57 of the engine exhaust manifold 41 cooperates with an exhaust passageway 58 formed in the exhaust guide plate 42.

An exhaust pipe and associated cooling jacket arrangement, indicated generally by the reference numeral 59, is affixed, in a manner to be described, to the underside of the exhaust guide 58 and receives these exhaust gases. The exhaust gases are then transferred through an exhaust passage 61 that extends downwardly into the lower portion of the drive shaft housing 25 into an expansion chamber 62 that is formed by an inner wall surface 63 of the outer housing 49 of the drive shaft housing assembly 25. The expansion chamber 62 communicates with a further chamber 64 formed in the lower unit housing 45 and which communicates with a through-the-hub underwater exhaust gas discharge passage 65 formed in the propeller 47.

Under higher speed conditions, the associated watercraft 23 is in a planing condition and is not very deeply submerged. Hence, this low submersion plus the high exhaust pressure lets the exhaust gases be discharged in this manner. When traveling at slower speeds, however, or at idle, through-the-hub discharge 65 is relatively deeply submerged. At this time, the exhaust gas pressure is also relatively low and hence the exhaust gases cannot easily exit through this path.

Therefore, there is provided an above-the-water exhaust gas discharge for discharging the exhaust gases under this condition. This above-the-water exhaust gas discharge includes a further chamber 66 which is formed in a rearward portion of the drive shaft outer housing element 49. An above-the-water exhaust gas discharge port 67 communicates this expansion chamber at a point above the water level under all running conditions with the atmosphere. A restricted flow path to be described is provided to the expansion chamber 66 so as to preclude large amounts of exhaust gases flowing through this pass when the watercraft is running at higher speeds. This path will be described in more detail later and is formed in major part in the member 59.

The watercraft engine 27 is water-cooled. Therefore, the cylinder block 28 is provided with a cooling jacket, indicated by the reference numeral 68 and which, among other things, encircles the cylinder bores 29 for their cooling. In a like manner, the cylinder head assembly 39 is provided with a cooling jacket and the cooling jackets of both the cylinder block and cylinder head are connected to each other in a suitable flow pattern.

Cooling water for cooling the engine is drawn from the body of water in which the watercraft is operating through a water inlet opening 69 (FIG. 1) formed in the outer face of the lower unit outer housing 45. This inlet opening communicates with a vertically extending passage 71 which extends to the inlet side of a water pump 72 which also appears in FIG. 2. This water pump, as is typical in outboard motor practice, is directly driven off of the drive shaft 73 at the inter face between the outer housings 49 and 45 of the drive shaft housing 25 and lower unit 26, respectively.

This water is then delivered upwardly through a supply pipe 73. This supply pipe 73 extends through an opening 74 that is formed in a flange portion 75 of the exhaust pipe member 59. This flange portion 75 is provided with a plurality of openings 76 through which threaded fasteners 77 (FIGS. 2–4) pass for affixing the exhaust pipe 59 to the underside of the exhaust guide plate 42.

This water then flows through a corresponding opening 78 in the exhaust guide plate 42 so as to enter into a combined water jacket and water passage forming cavities 79 formed in the upper surface of the exhaust guide 42. Among other things, this cavity 79 communicates directly with a downwardly facing inlet opening 81 of the cylinder block water jacket 68. Thus, cooling water is delivered directly via this path into the engine cooling jacket 68 for cooling of the engine.

As best seen in FIG. 2, the cylinder block water inlet 81 is also provided with a bypass port 82 which communicates with a chamber 83 formed in the lower face of the cylinder block 28 and the upper face of the exhaust guide 83. As may be seen in FIG. 4, this water jacket 83 is provided with a supply passage 84 that communicates directly with a cooling jacket, indicated generally by the reference numeral 85 which is formed in the exhaust pipe assembly 59.

Communication with this exhaust pipe water jacket 85 is provided by a recess 86 formed in the lower face of the exhaust guide 42. The water jacket 85 is formed primarily by an outer wall portion 87 of the exhaust pipe 59, which portion 87 lies on opposite sides of the exhaust passage 61 and thus is in good heat exchanging relationship with the exhaust gases. This portion 87 has a pair of downwardly extending parts 88 that depend below the lower end of the exhaust passage 61. For ease of understanding, the outer peripheral circuits of the portion that defines the exhaust passage 61 is identified by the reference numeral 89.

Figure 4:
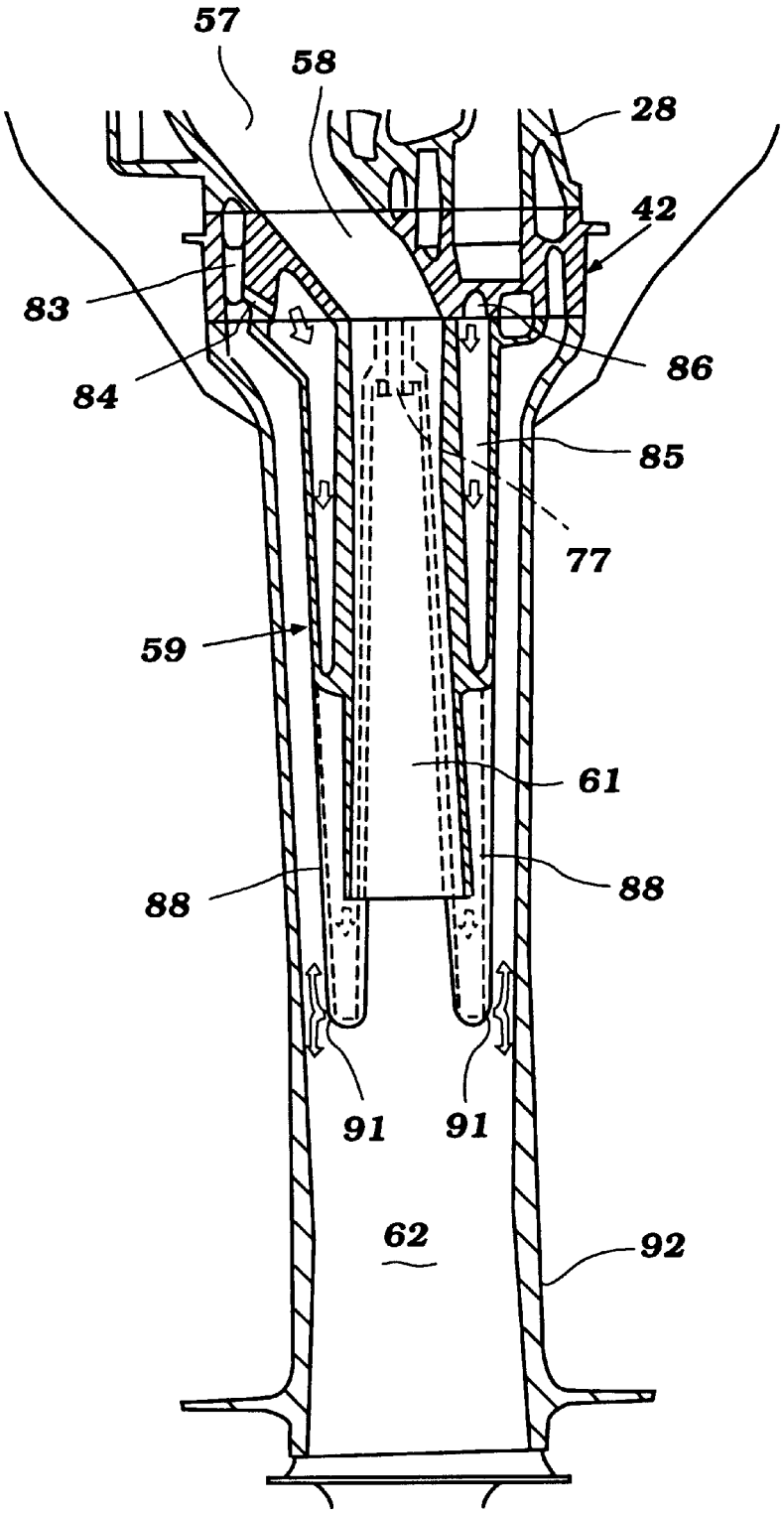
FIG. 4 is an enlarged, partial view looking in the same direction as FIG. 3.

The depending portions 88 are formed with discharge ports 91 in their outer surfaces and which discharge ports 91, as best seen in FIG. 4, face the inner wall of a portion 92 of the drive shaft housing assembly 25 that defines the expansion chamber 62 and away from the exhaust discharge end of the exhaust passage 61. As a result, the water will impinge upon the expansion chamber walls and cool them, and also be well spaced from the exhaust gases so that even negative pulses which may exist will not draw the water into the engine through the exhaust system.

A further restricted passageway 93 is also provided between the water inlet cavity 83 of the exhaust guide plate 42 and the exhaust pipe cooling jacket 85. This appears in FIGS. 13 and 14.

In addition to the fresh coolant that has not passed through the cooling jacket 68 of the engine 27, there is also supplied some coolant to the exhaust pipe cooling jacket 85 that has passed through the engine cooling jacket. This will somewhat moderate the temperature of the cooling water that is delivered to the exhaust pipe cooling jacket 85. Nevertheless, this coolant will be cooler than the coolant which has passed through the engine cooling jacket 68. This warmer cooling water is delivered through a pair of passages 94 and 95 (FIGS. 13 and 14) which communicate with the upper portion of the cooling jacket 85.

The drain openings 91 formed in the lower part of the cooling jacket 85 are not sufficient so as to drain all of the water which is delivered to this cooling jacket. However, they do ensure that when the engine is running even at low speeds, that this cooling jacket will be filled with water.

Figure 14:
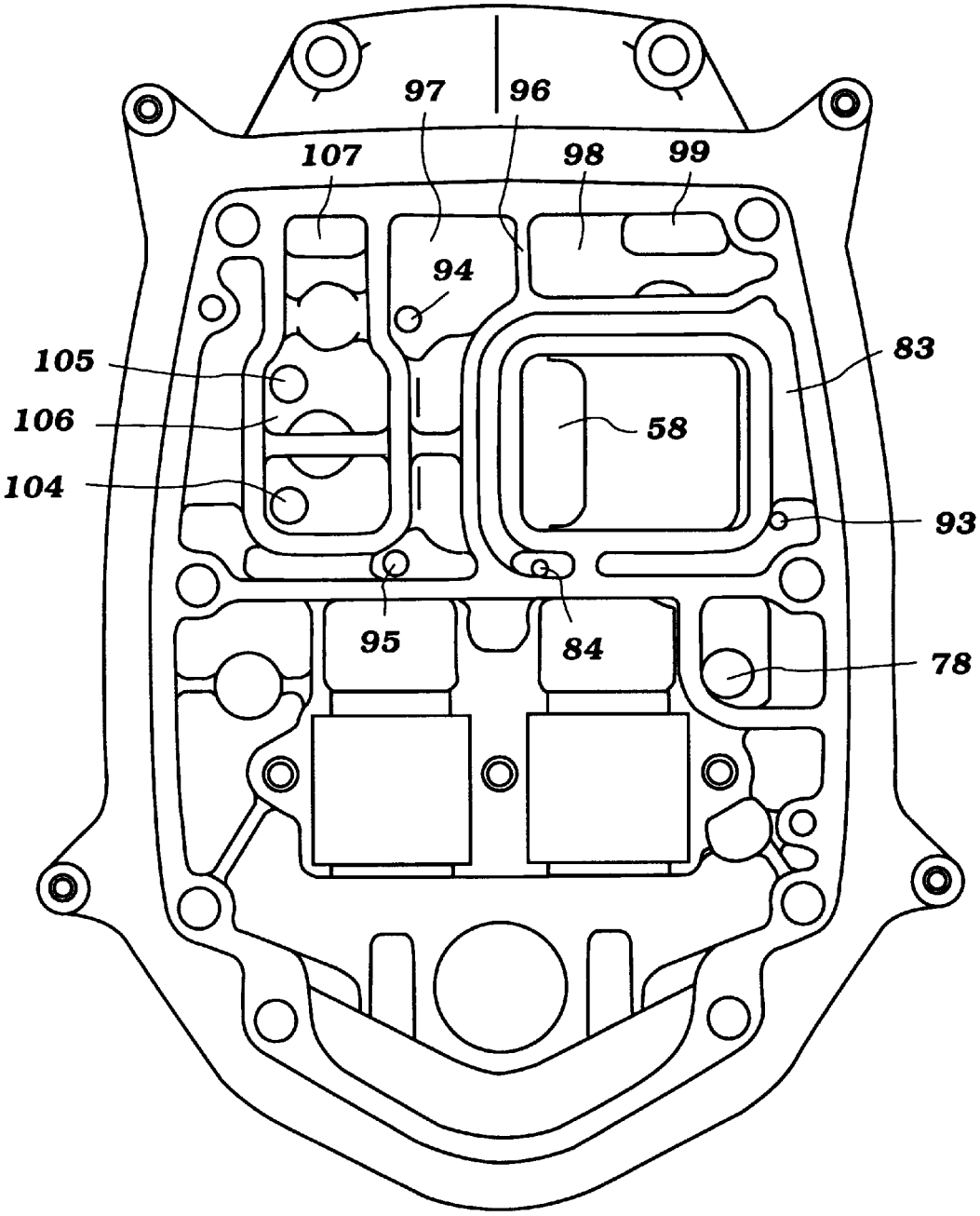
FIG. 14 is a top plan view of the exhaust guide.

To provide further assurances, a weir 96 is formed in a chamber 97 on the upper surface of the exhaust guide plate 42 as seen in FIG. 14. Water may flow over this weir 96 into a drain area 98 which, in turn, discharges through a discharge port 99 to an area that is disposed to the rear of the exhaust pipe 59 as best seen in FIG. 2. This cooling water cools the expansion chamber 66 for the low speed exhaust gas discharge. The water may exit this chamber 96 through a drain passage 101 (FIG. 1) formed in the outer housing 45 of the lower unit 26.

From the foregoing description, it should be readily apparent that even though the cooling jacket 85 of the exhaust pipe 59 is constantly filled with water when the engine is running, only a small amount of water will be discharged by the cooling system into the expansion chamber 62 through the openings 91. Also, these openings 91 are directed away from the lower end of the exhaust pipe discharge passage 61 and hence the likelihood of ingestion of water into the engine through the exhaust system is substantially precluded.

Figure 5:
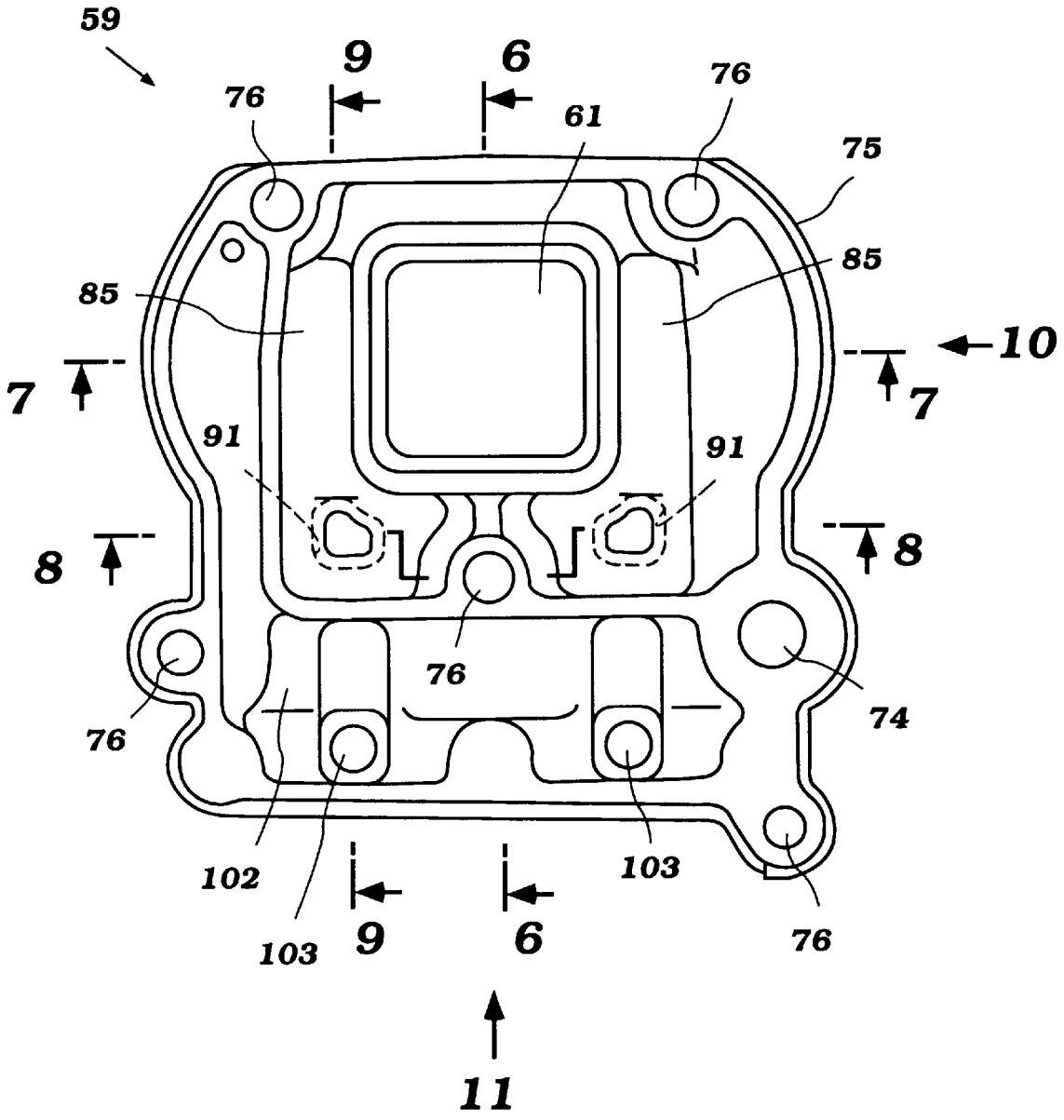
FIG. 5 is a top plan view showing the construction of the exhaust pipe and its associated cooling jacket arrangement.
Figure 6:
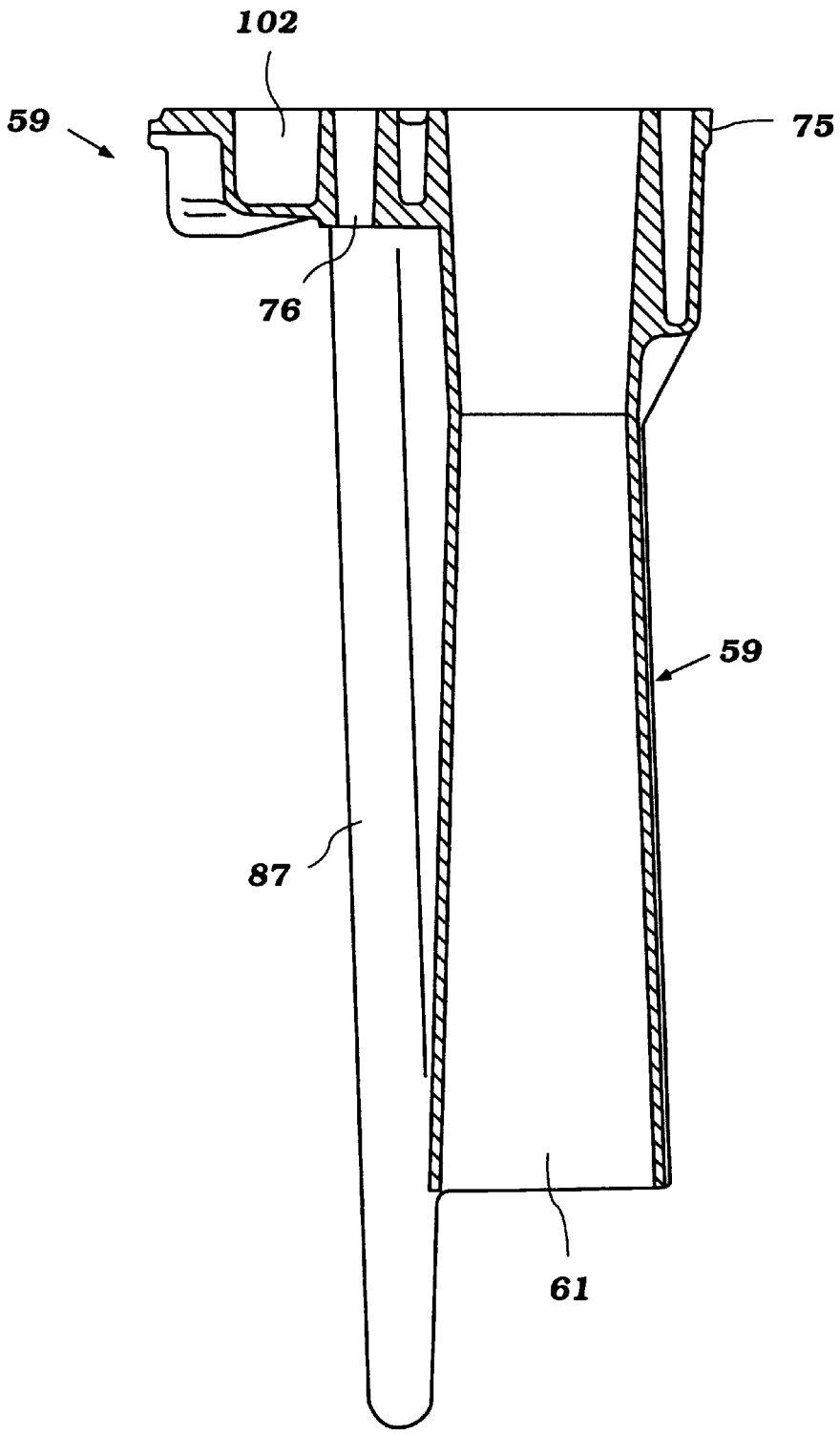
FIG. 6 is a cross-sectional view taken along the line 6—6 of FIG. 5.
Figure 7:
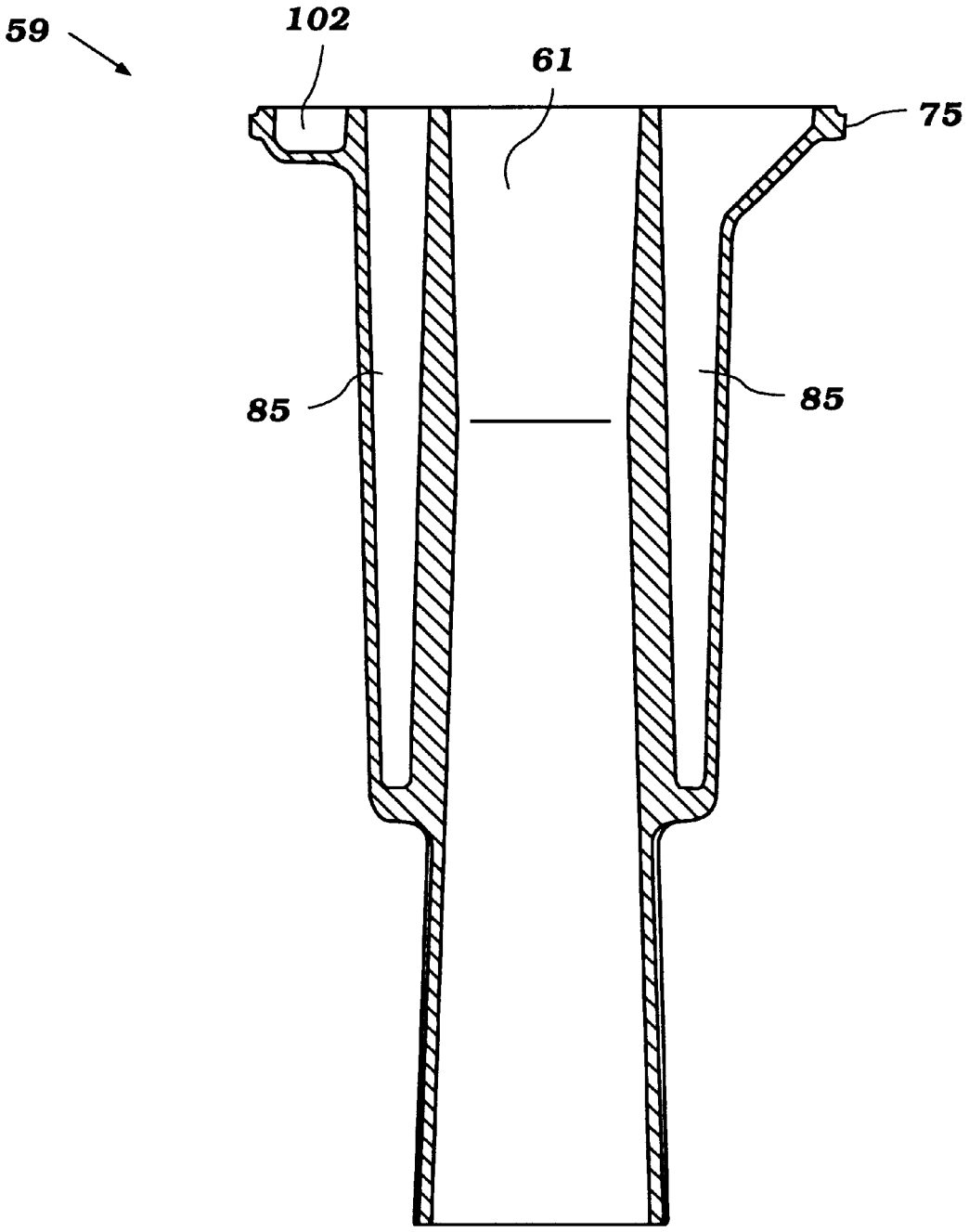
FIG. 7 is a cross-sectional view taken along the line 7—7 of FIG. 5.
Figure 8:
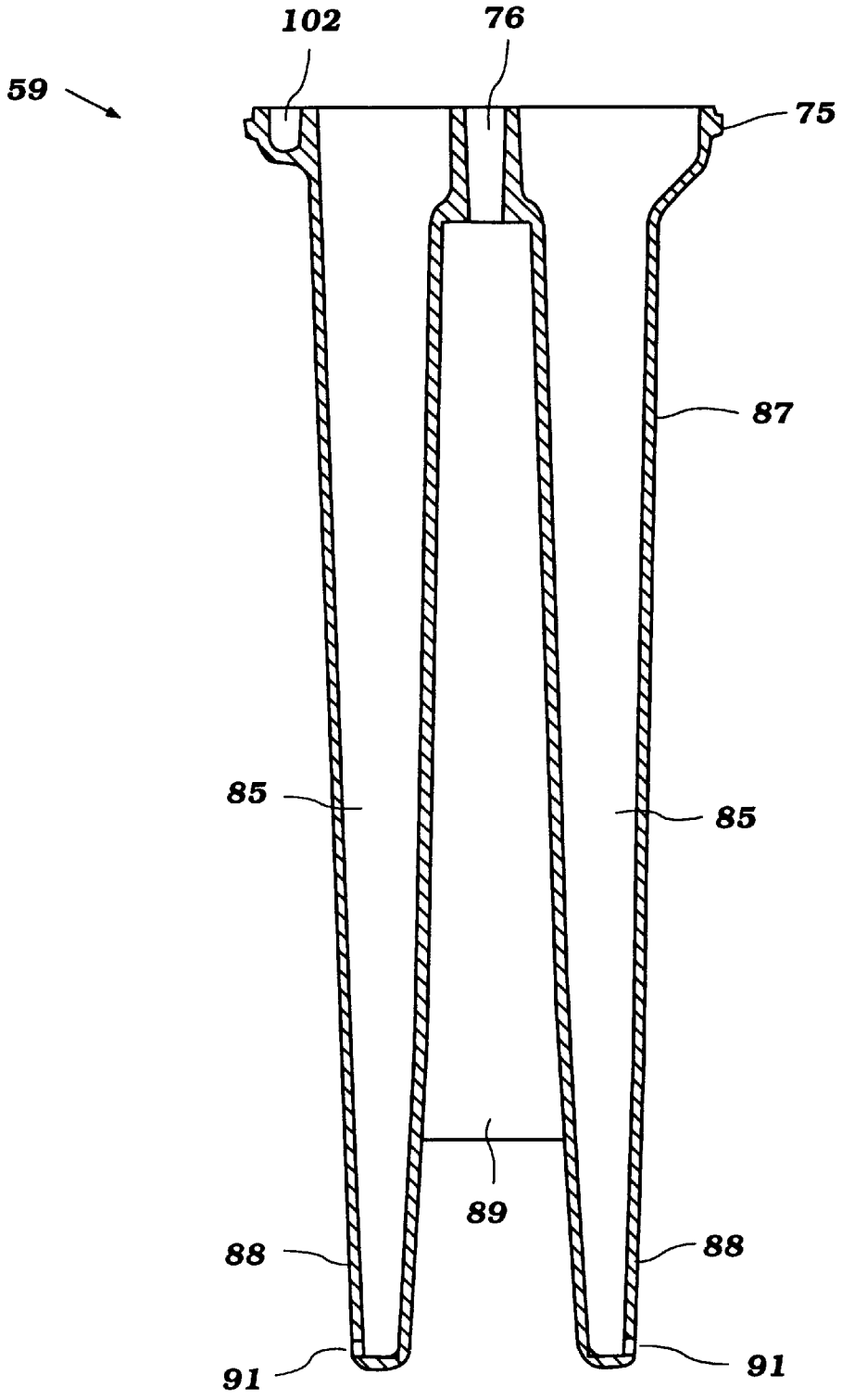
FIG. 8 is a cross-sectional view taken along the line 8—8 of FIG. 5.
Figure 9:
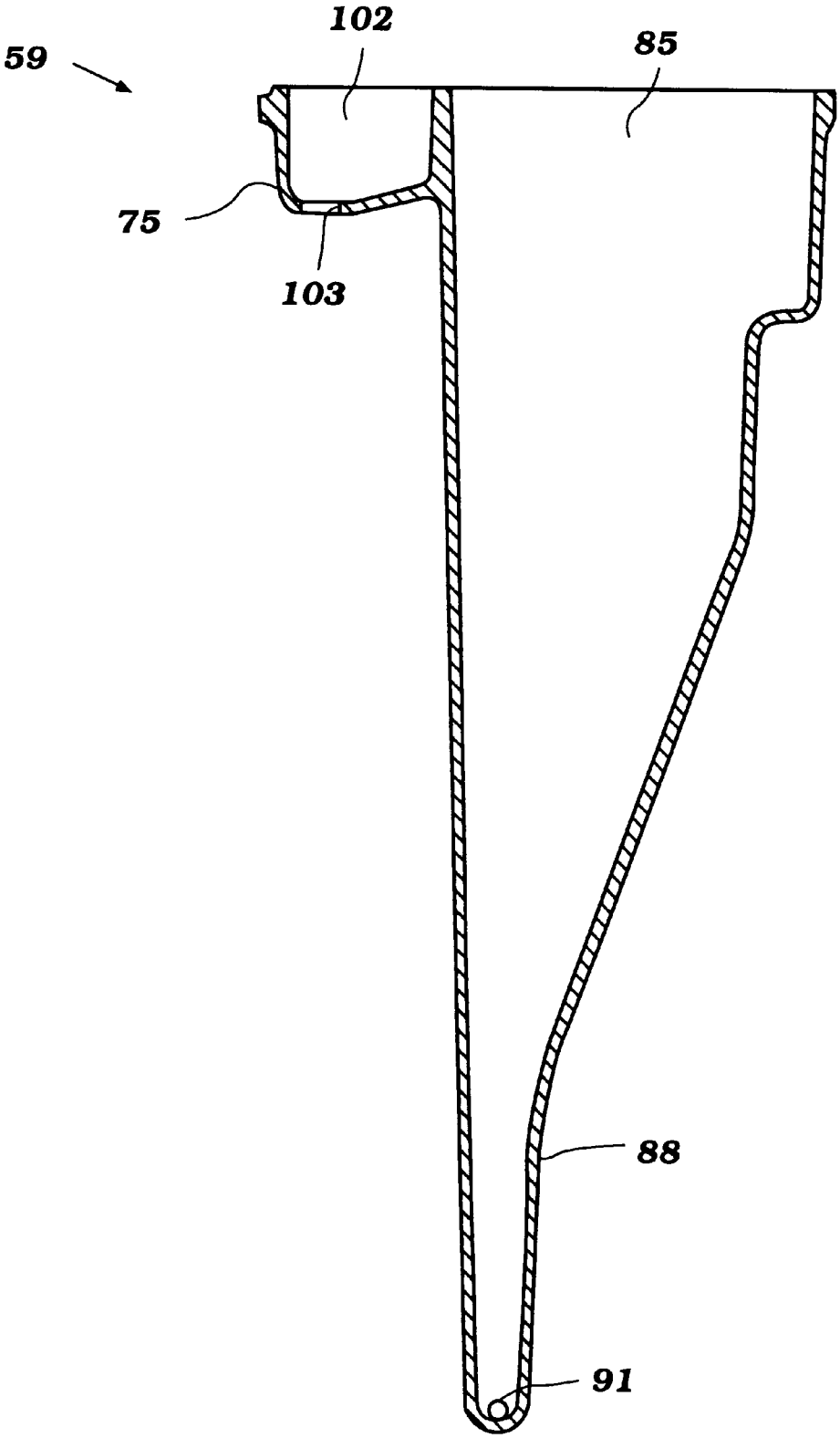
FIG. 9 is a cross-sectional view taken along the line 9—9 of FIG. 5.
Figure 10:
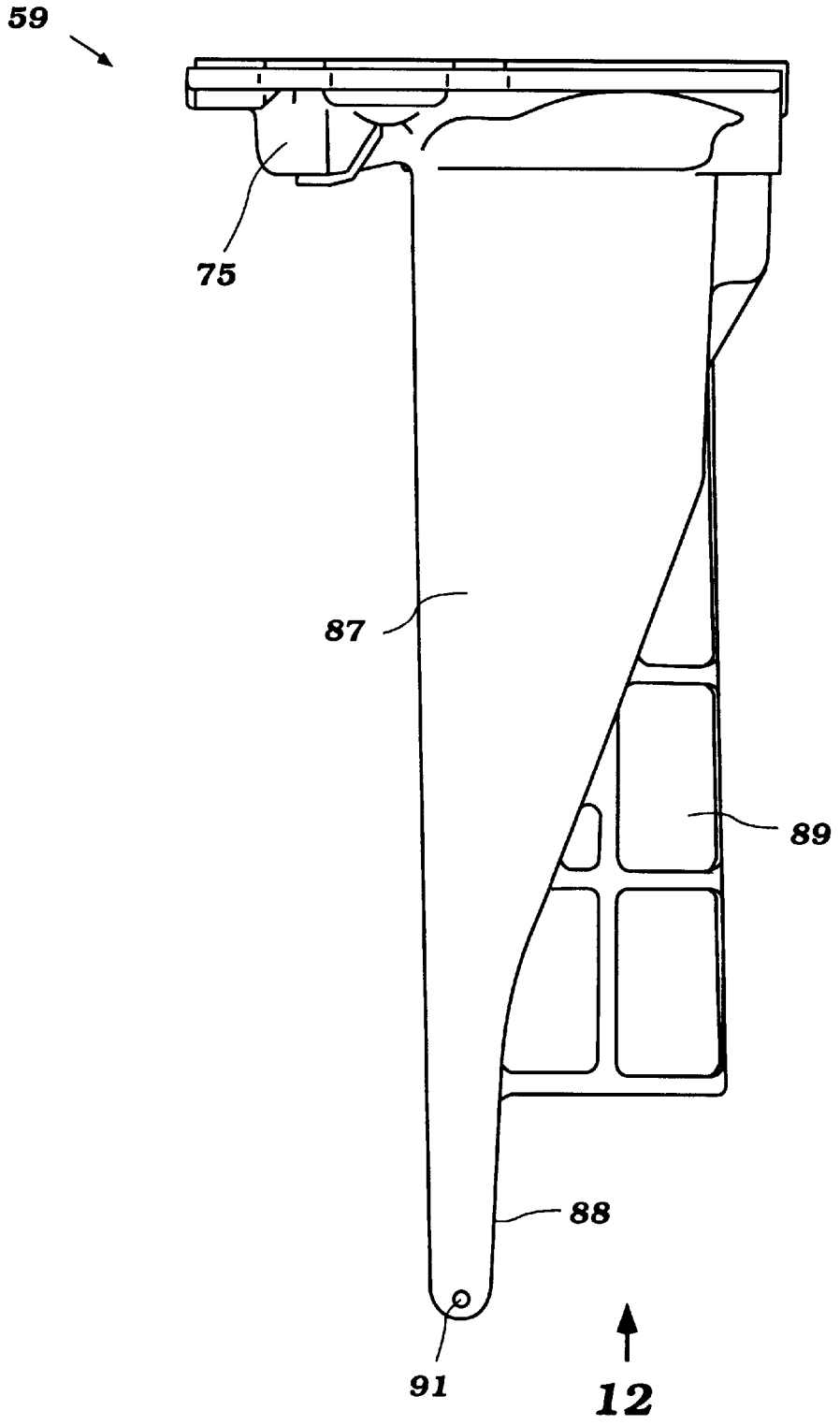
FIG. 10 is a side elevational view looking in the direction of the arrow 10 in FIG. 5.
Figure 11:
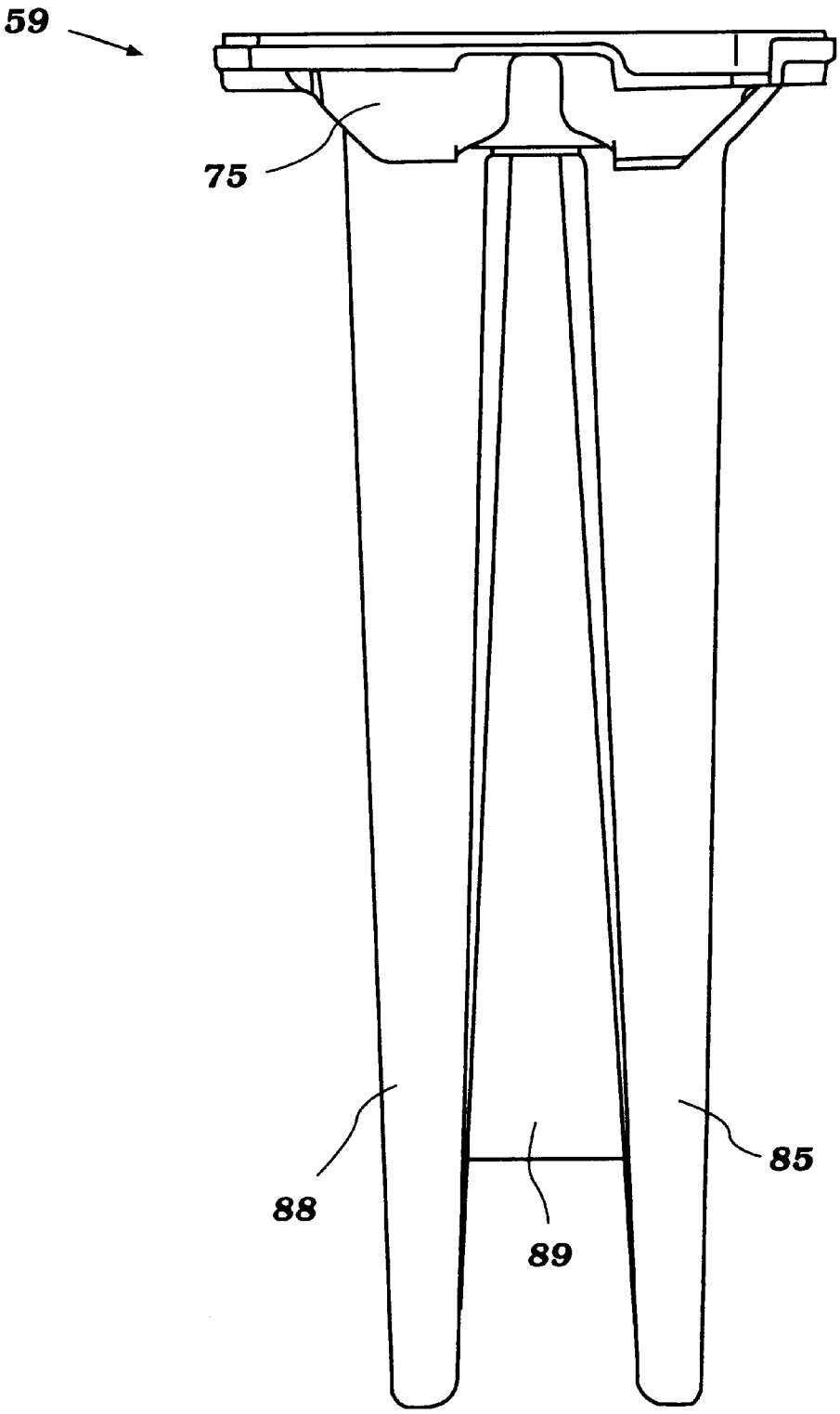
FIG. 11 is a front elevational view looking in the direction of the arrow 11 in FIG. 5.
Figure 12:
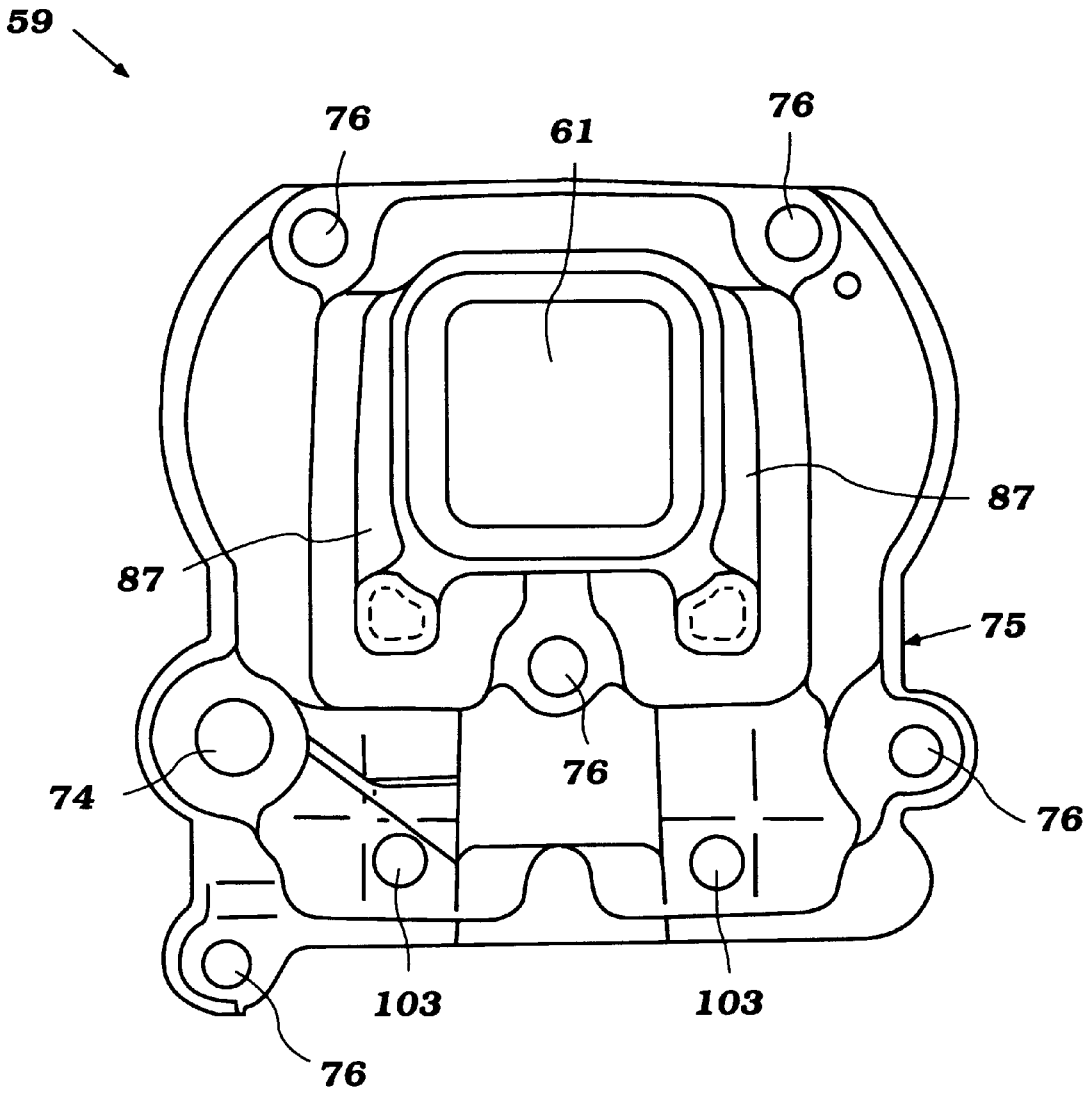
FIG. 12 is a bottom plan view looking in the direction of the arrow 12 in FIG. 10.

The path of the exhaust gases to the expansion chamber 69 for silencing the low speed exhaust gas discharge and also for limiting the amount of exhaust gases flowing through this path will now be described. This path is provided primarily by an idle discharge passage 102 (FIG. 5) that begins to the forward portion of the flange 75 of the exhaust pipe 59 and the area forwardly of the cooling jacket 85.

Figure 13:
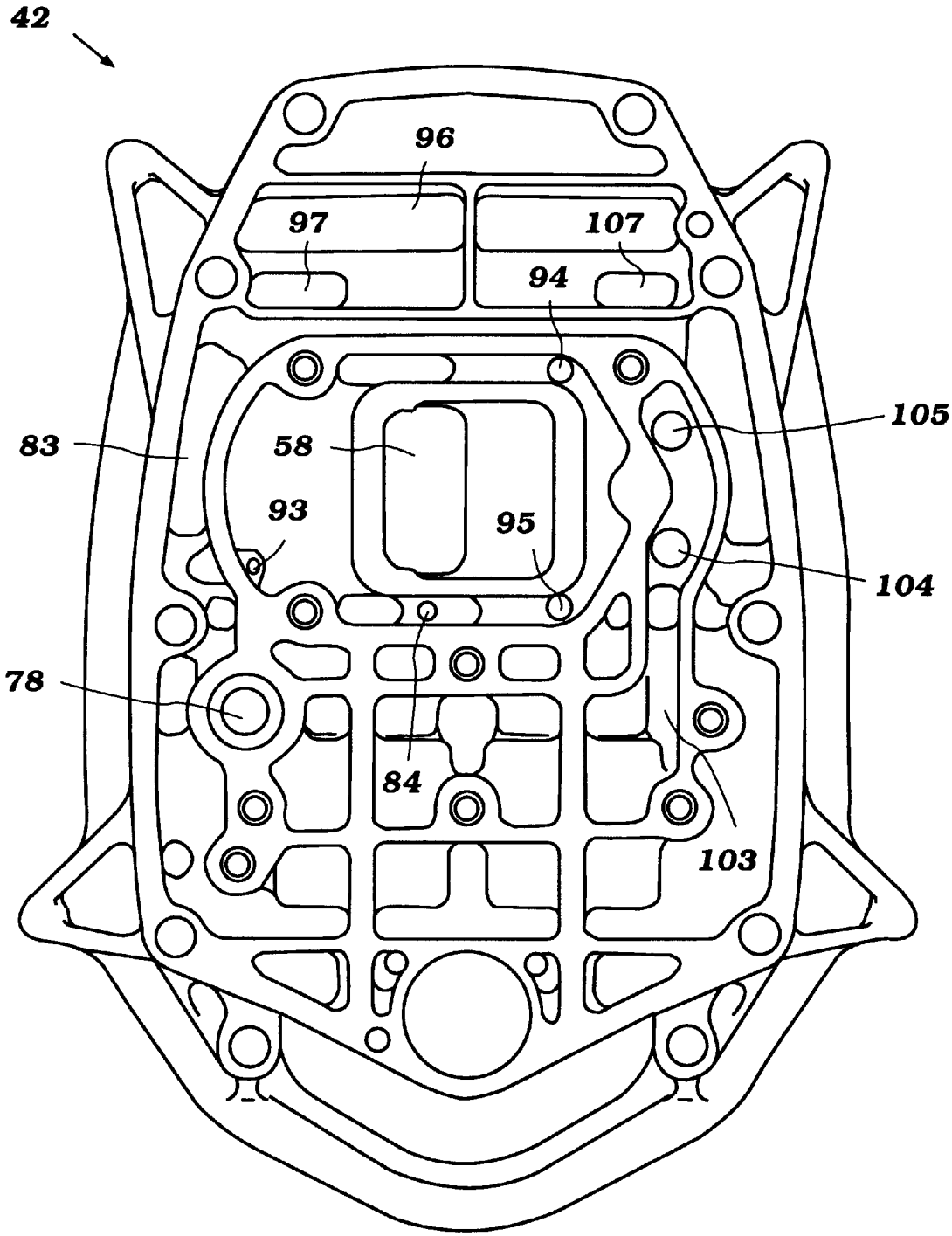
FIG. 13 is a bottom plan view of the exhaust guide.

Exhaust gases can enter this area from the expansion chamber 62 through a pair of idle exhaust openings 103 formed in a lower wall of the flange portion 75 of the exhaust pipe 59. This passageway 102 communicates with a slot 103 formed in the underside of the exhaust guide 42 as seen in FIG. 13. This slot 103 has a pair of idle exhaust gas discharge ports 104 and 105 that communicate with a further chamber 106 formed in the upper surface of the exhaust guide 42 as seen in FIG. 14.

In turn, this passageway 106 communicates with a downwardly extending opening 107 that passes through the exhaust guide 42 in an area to the rear of the exhaust pipe 59 and specifically its flange portion 75. This discharge passageway 107 communicates with the upper portion of the expansion chamber 66 adjacent to the area where the cooling water is returned by the drain 99.

From the foregoing description, it should be apparent that the exhaust path for the idle gases has several expansions and contractions and also brings the idle exhaust gases into more direct contact with the discharged coolant to assist in their cooling and also to restrict the flow through this path.

Thus, from the foregoing description, it should be readily apparent that the described construction provides a very effective exhaust system for an outboard motor wherein the exhaust gases are well cooled and also wherein the coolant that cools the exhaust gases is kept out of contact with the discharge from the exhaust pipe so that ingestion of water into the engine through the exhaust system is precluded. Of course, the foregoing description is that of a preferred embodiment of the invention, and various changes and modifications can be made without departing from the spirit and scope of the invention, as defined by the appended claims.

I claim:

1. An outboard motor comprised of a power head and a drive shaft housing and lower unit depending from said power head, said power head containing a powering internal combustion engine and a surrounding protective cowling, a propulsion device contained within said lower unit for propelling an associated watercraft through a body of water in which it is operating, a transmission system for transmitting drive from said engine to said propulsion device, an expansion chamber formed in said drive shaft housing, said expansion chamber being defined by a peripheral wall, an exhaust pipe depending from said engine into said expansion chamber for delivery of exhaust gases to said expansion chamber, a cooling jacket provided along a side of said exhaust pipe and formed integrally with said exhaust pipe, said cooling jacket receiving liquid coolant for cooling said exhaust pipe, and a discharge passage from said cooling jacket is directed toward the peripheral wall of the expansion chamber and away from the exhaust pipe for returning liquid coolant from said cooling jacket to the body of water in which the watercraft is operating.

2. An outboard motor as set forth in claim 1, wherein the cooling jacket extends substantially completely around the inlet end of the exhaust pipe.

3. An outboard motor as set forth in claim 1, wherein the cooling jacket has a portion that extends below the lowermost end of the exhaust pipe.

4. An outboard motor as set forth in claim 3, wherein the discharge passage is formed in the depending portion of the cooling jacket.

5. An outboard motor as set forth in claim 4, wherein there are a pair of depending portions formed on diametrically opposite sides of the exhaust pipe, each having a discharge passage below the end of the exhaust pipe, said discharge passages discharging fluid in opposite directions and generally perpendicularly to the direction of exhaust flow through said exhaust pipe.

6. An outboard motor as set forth in claim 3, wherein the liquid coolant supplied to the cooling jacket is drawn from the body of water in which said outboard motor is operating.

7. An outboard motor as set forth in claim 2, wherein the expansion chamber communicates with the atmosphere through a below the water high speed exhaust gas discharge.

8. An outboard motor as set forth in claim 7, further including an above the water low speed exhaust gas discharge formed in a second expansion chamber and further including means communicating the first mentioned expansion chamber with the second expansion chamber.

9. An outboard motor as set forth in claim 8, wherein the two expansion chambers communicate with each other through a path formed in part by the exhaust pipe.

10. An outboard motor as set forth in claim 9, wherein the cooling jacket is formed integrally with the exhaust pipe.

11. An outboard motor as set forth in claim 10, wherein the cooling jacket extends substantially completely around the inlet end of the exhaust pipe.

12. An outboard motor as set forth in claim 11, wherein the cooling jacket has a depending portion that extends below the lowermost end of the exhaust pipe.

13. An outboard motor as set forth in claim 12, wherein the discharge passage is formed in the depending portion of the cooling jacket.

14. An outboard motor as set forth in claim 12, wherein there are a pair of depending portions formed on diametrically opposite sides of the exhaust pipe, each having a discharge passage below the end of the exhaust pipe, said discharge passages discharging fluid in opposite directions and generally perpendicularly to the direction of exhaust flow through said exhaust pipe.

15. An outboard motor as set forth in claim 14, wherein the liquid coolant supplied to the cooling jacket is drawn from the body of water in which said outboard motor is operating.

16. An outboard motor as set forth in claim 15, wherein the engine is water cooled and a single cooling pump delivers water from the body of water to the cooling jacket and to an engine cooling jacket in parallel flow paths.

17. An outboard motor as set forth in claim 16, wherein some of the coolant delivered to the cooling jacket is delivered from the engine cooling jacket after having passed through said engine cooling jacket.

18. An outboard motor as set forth in claim 16, wherein a weir is formed at an upper area of the cooling jacket and coolant may flow over the weir for discharge back to the body of water in which the watercraft is through the second expansion chamber.

19. An outboard motor comprised of a power head and a drive shaft housing and lower unit depending from said power head, said power head containing a powering internal combustion engine and a surrounding protective cowling, said engine being water cooled and having an engine cooling jacket, a propulsion device contained within said lower unit for propelling an associated watercraft through a body of water in which it is operating, a transmission system for transmitting drive from said engine to said propulsion device, an expansion chamber formed in said drive shaft housing, said expansion chamber being defined by a peripheral wall, an exhaust pipe depending from said engine into said expansion chamber for delivery of exhaust gases to said expansion chamber, a cooling jacket provided along a side of said exhaust pipe and receiving liquid coolant for cooling said exhaust pipe, a single cooling pump for delivering water from the body of water in which said outboard motor is operating to said cooling jacket and to said engine cooling jacket in parallel flow paths, and a discharge passage from said cooling jacket below the lower end of said exhaust pipe for returning liquid coolant from said cooling jacket to the body of water in which the watercraft is operating.

20. An outboard motor as set forth in claim 9, wherein some of the coolant delivered to the cooling jacket is delivered from the engine cooling jacket after having passed through said engine cooling jacket.

21. An outboard motor as set forth in claim 9, wherein a weir is formed at an upper area of said cooling jacket over which coolant may flow for discharge back to the body of water in which said outboard motor is operating independantly of the discharge passage, but in a direction away fro the exhaust pipe.

22. An outboard motor comprised of a power head and a drive shaft housing and lower unit depending from said power head, said power head containing a powering internal combustion engine and a surrounding protective cowling, a propulsion device contained within said lower unit for propelling an associated watercraft through a body of water in which it is operating, a transmission system for transmitting drive from said engine to said propulsion device, an expansion chamber formed in said drive shaft housing, said expansion chamber being defined by a peripheral wall, an exhaust pipe depending from said engine into said expansion chamber for delivering of exhaust gases to said expansion chamber, a cooling jacket provided along a side of said exhaust pipe and receiving liquid coolant for cooling said exhaust pipe, said cooling jacket formed integrally with said exhaust pipe and extending substantially completely around an inlet end of said exhaust pipe, and having a portion that extends below a lowermost end of said exhaust pipe, a below-the-water high-speed exhaust gas discharge communicating between the expansion chamber and the atmosphere, a path from the expansion chamber to a second expansion chamber, the path formed in part by the exhaust pipe, an above-the-water low-speed exhaust gas discharge formed in the second expansion chamber, and a discharge passage from said cooling jacket below the lower end of said exhaust pipe for returning liquid coolant from said coolant jacket to the body of water in which the watercraft is operating.

23. An outboard motor comprised of a power head and a drive shaft housing and lower unit depending from said power head, said power head containing a powering internal combustion engine and a surrounding protective cowling, said engine being water cooled and having an engine cooling jacket, a propulsion device contained within said lower unit for propelling an associated watercraft through a body of water in which it is operating, a transmission system for transmitting drive from said engine to said propulsion device, an expansion chamber formed in said drive shaft housing, said expansion chamber being defined by a peripheral wall, an exhaust pipe depending from said engine into said expansion chamber for delivery of exhaust gases to said expansion chamber, a cooling jacket provided along a side of said exhaust pipe and receiving liquid coolant for cooling said exhaust pipe, a single cooling pump for delivering water from the body of water in which said outboard motor is operating to said engine cooling jacket and said cooling jacket in parallel flow paths, at least some of the water being delivered from said engine cooling jacket to said cooling jacket after passing through said engine cooling jacket, a below-the-water high-speed exhaust gas discharge communicating with the expansion chamber, a path connecting said expansion chamber to a second expansion chamber, said path formed in part by said exhaust pipe, an above-the-water low-speed exhaust gas discharge formed in said second expansion chamber, and a discharge passage from said cooling jacket below the lower end of said exhaust pipe for returning liquid coolant from said cooling jacket to the body of water in which the watercraft is operating, wherein a weir is formed at an upper area of the cooling jacket and coolant may flow over the weir for discharge back to the body of water in which the watercraft is operating through the second expansion chamber.

24. An outboard motor as set forth in claim 23, wherein the discharge passage from the cooling jacket is directed toward the peripheral wall of the expansion chamber and away from the exhaust pipe.

* * * * *